US005107780A

United States Patent [19]

Braun

[11] Patent Number: 5,107,780

[45] Date of Patent: Apr. 28, 1992

[54] PATTERN MATCH SEWING MACHINE

[75] Inventor: Hans-Peter Braun, Kaiserslautern, Fed. Rep. of Germany

[73] Assignee: G. M. Pfaff Aktiengesellschaft, Kaiserslauter, Fed. Rep. of Germany

[21] Appl. No.: 765,029

[22] Filed: Sep. 24, 1991

[30] Foreign Application Priority Data

Sep. 26, 1990 [DE] Fed. Rep. of Germany ..... 4030421

[51] Int. Cl.[5] ..... D05B 27/06; D05B 27/08

[52] U.S. Cl. ..... 112/314; 112/121.11; 112/320

[58] Field of Search ..... 112/314, 313, 306, 312, 112/315, 320, 121.11, 272, 121.12

[56] References Cited

U.S. PATENT DOCUMENTS 4,982,677 1/1991 Nomura et al. ..... 112/314

5,001,998 3/1991 Suzuki et al. ..... 112/121.11 X

*Primary Examiner*—Peter Nerbun

*Attorney, Agent, or Firm*—McGlew & Tuttle

[57] ABSTRACT

A device for sewing together two fabric parts includes two pattern sensors and correcting means for determining and correcting misalignment of patterns on the fabric parts. Also, an additional image sensor (18) is provided, which scans the surface of the fabric (16) to be sewn at the site of an intermediate storage location (15) before this fabric is fed into the sewing machine. An image-processing device connected to this additional image sensor generates data on certain basic characteristics of the fabric pattern, such as color, contrast, lightness, register length, and angular orientation of the pattern components. From these characteristic data, a decision logic circuit determines setting data for the operating parameters of the devices used in the sewing machine for detecting and correcting a possible pattern misalignment during sewing.

14 Claims, 3 Drawing Sheets

PATTERN MATCH SEWING MACHINE

FIELD OF THE INVENTION

The present invention pertains to a device for sewing together two fabric parts according to a pattern using a sewing machine which has a separate feed mechanism for each of the two fabric parts to be sewn together, as well as a separate pattern sensor located in the vicinity of the stitch formation site for scanning the fabric part in question in at least one predetermined direction relative to an edge to be sewn to generate a pattern signal.

BACKGROUND OF THE INVENTION

Many such devices have been known and are used to automate the sewing together of patterned fabrics, so that the sewing machine operator is relieved of the laborious task of bringing about the desired matching of the pattern structures of the two fabric parts at the sewing site by joining manually and monitoring continuously.

For sewing together according to the pattern, the two fabric parts are usually placed one on top of another such that their faces lie facing one another, and the pattern structures match at least at the site of the seam to be prepared. To accurately bring about this matching automatically, a separate feed system is provided for each fabric part, so that a relative movement between the two fabric parts can be brought about by specifically acting on at least one of these systems in order to compensate for a possible misalignment of the pattern structures. The existence of a misalignment is determined by comparative analysis of two pattern signals which originate from two pattern sensors, each of which scans one of the two fabric parts in order to produce a pattern signal representing the pattern-related variations in light intensity. If only a pattern misalignment in the direction along the seam is determined and corrected, one speaks of one-dimensional misalignment correction. The pattern sensors used for this purpose are usually designed to be such that their field of view has a small extension in the direction of movement of the fabric parts, i.e., in the direction of the seam, and a large extension in the direction perpendicular to that direction, as is described in, e.g., DE 33,46,163 C1. As a result, high resolution is achieved in the direction of movement (scanning direction), while stochastic and systematic effects (e.g., effects caused by longitudinal stripes) of the pattern or fabric structure are reduced at the same time due to summation of the light intensity at right angles to the direction of feed.

Various analytical methods or algorithms are known for determining the degree of matching or the misalignment of the patterns of the two fabric parts from the two pattern signals. In the method described in the above-mentioned DE 33,46,163 C1, the cross-correlation function of the two pattern signals is used to determine the misalignment, and their shift is determined from their normal position (null position). According to another method, known from DE 37,04,824 A1, the pattern signals are differentiated such that sharp needle impulses of one polarity or another are obtained from the ascending and descending flanks of the pattern signals, which correspond to the edges of the pattern components. The two impulse trains thus obtained appear with a phase shift relative to one another in the case of a pattern misalignment, which is determined by superimposing the two impulse trains and measuring the distances between impulses, taking into account the actual polarity of the impulse. It is also possible to superimpose the two pattern signals to be differentiated on one another and to measure the differential surface of the two curves in order to thus determine the pattern misalignment, as is known from, e.g., DE 39,02,473 A1.

Using the above-mentioned one-dimensional misalignment correction, it is possible to align only patterns which are directed at right angles to the direction of sewing, i.e., horizontal or diagonal stripe patterns. However, there are also known devices for sewing together, according to a the pattern, fabric parts which have two-dimensional, intersecting patterns (such as check designs) or patterns which are located in the direction of sewing (such as vertical stripes). As is described in, e.g., DE 37,38,893 A1, two-dimensional image sensors are used for this purpose, each of which is provided for detecting the pattern in a preset rectangular frame. Using a two-dimensional cross-correlation function, the values of the pattern misalignment are then determined in two mutually perpendicular directions from the image data of the two sensors. To correct the pattern misalignment on the basis of the values determined, the two feed systems are designed to be such that they are able to displace the corresponding fabric parts relative to one another not only in the direction of sewing, but also in a direction perpendicular to it (i.e., at right angles to the seam).

It is desirable to design a device for automatic sewing together such that the greatest possible number of types of fabric patterns is able to be processed with it. For this reason, the pattern sensors or the correction device in some prior-art devices can be adjusted to the pattern in question by special settings. For example, it has been known from the above-mentioned DE 33,46,163 C1 that to better detect obliquely extending pattern components, the angular orientation of the linear pattern sensors is adjusted according to the angular orientation of the pattern stripe. The repetition period (register length or distance between stripes) of the patterns to be detected, which differs from one case to the next, is also a specific magnitude to which some known devices can be adjusted prior to the sewing process in order to adjust to it the algorithm used to compute the pattern misalignment (cf., e.g., the above-mentioned DE 39,02,473 A1) or to distribute the feed correction to eliminate the pattern misalignment, in the case of greater register lengths, more uniformly over the sewing section to keep curling of the seam at a minimum, as is known from DE 39,02,474 A1.

There are also patterns whose structures cannot be recognized from lightness values, e.g., when the pattern consists of stripes of two different colors of equal lightness. Such problems can be solved by setting the color selectivity of the pattern sensors, e.g., by inserting a color filter for one of the two colors in the path of rays of these sensors, as is mentioned in the introduction of the above-mentioned DE 39,02,473 A1. According to an alternative described in the same document, color-discriminating sensors, which deliver three pattern signals for three primary color components, are used as the pattern sensors. Of the three component signals, the one which has the highest peak-to-peak amplitude after differentiation, is then automatically used to compute the misalignment.

It is also advantageous if the correction device is able to select between different algorithms to compute the pattern misalignment. Complicated patterns require—for detection and misalignment computation—a relatively complicated algorithm which requires a large computation capacity or a long computation time, while a simpler algorithm, which can be carried out more rapidly, may be sufficient for simple patterns. To take such circumstances into account, a possibility of adjustment for selecting the mode of computation to be applied is provided in the device known from DE 39,02,473 A1.

To carry out the above-mentioned settings in terms of the register length, the angular orientation of the pattern, and the preferable mode of computation, the sewing machine operator must have a sure eye and much experience in order to be able to decide what adjustments to make on the basis of an existing pattern. Skilled manpower is also required, and this is also the time that the sewing machine operator needs between the individual sewing processes to observe and evaluate the pattern and to perform the corresponding adjustments, which is taken at the expense of the sewing time proper.

SUMMARY AND OBJECTS OF THE INVENTION

It is an object of the present invention to design a device for sewing together two fabric parts according to the pattern such that they will be able to process a wide variety of fabric patterns while ensuring efficient utilization of the occupation time of the sewing machine.

According to the invention, a device for sewing together two fabric parts is provided using a sewing machine which includes a separate feed mechanism for feeding each of the two fabric parts which are to be sewn together. The sewing machine additionally includes a separate pattern sensor located in the vicinity of a stitch formation site. The pattern sensor optically scans the fabric part in question in at least one predetermined direction relative to an edge to be sewn, in order to generate a pattern signal representing the pattern dependent variations in light intensity. A correction device is provided which determines a one-dimensional or two-dimensional misalignment of the patterns of the two fabric parts by comparative analysis of the pattern signals of the two pattern sensors. The correcting device sends a signal to act on at least one of the feed mechanisms to correct the misalignment. Setting means are provided for setting operating parameters of a functional group formed by the pattern sensors and the correcting device as a function of the basic characteristics of the pattern of the fabric parts. An additional image sensor is provided for viewing a temporary storage site at which the fabric parts are temporarily stored before being fed to the sewing machines. This additional image sensor optically scans the pattern of a fabric part located at the temporary storage site and generates a corresponding image signal. An image processing device is provided for processing the image signal generated by the additional image sensor. This image processing device generates characteristic data corresponding to basic characteristics of the pattern scanned and stores the data in a memory device. A decision logic circuit is provided for generating setting data for the above mentioned operating parameters from the characteristic data. The decision logic circuit sends the setting data to the associated setting means. A transfer device is provided which can be activated before beginning the sewing process in order to send the characteristic data stored to the decision logic circuit.

The device according to the present invention permits automation of the adjustments which are to be performed on a device for automatic sewing according to a pattern in order to adapt the operation of this device to different patterns. All the desired pieces of information on the basic characteristics of the pattern of a fabric to be sewn can be obtained with the image sensor provided according to the present invention and the image processing device connected to it, so that the sewing machine operator no longer has to personally evaluate the pattern. Since the image sensor is present in addition to the pattern sensors, and is located at the site where the fabric parts are temporarily stored, it is possible to sew together other fabrics during the time during which information is being obtained on the basic characteristics of a fabric pattern, so that the sewing machine can be optimally utilized.

The device according to the present invention does not only have the advantage that the machine operator is relieved of the task of evaluating certain characteristics of the pattern, such as the obliquity of the pattern, register length, and color, and performing corresponding adjustments. Another advantage is the fact that the image-processing device is also able to determine other characteristics of the pattern, which cannot directly be detected by observation and have therefore been mostly ignored in the prior-art devices. These include, e.g., contrast and lightness values of the pattern, which can be used to optimally adjust the gain and the amplitude offset of the pattern signal. The edge sharpness of the pattern components is also a piece of information which the image-processing device can obtain in order to generate adjusting data for selecting the algorithm to be used when computing the misalignment. For example, in the case of patterns with sharply marked edges, a relatively simple algorithm, which is based on the detection of the flanks in the pattern signals, may be sufficient. In contrast, in the case of patterns with nonsharp edges or with gradual transitions between adjacent pattern components, an algorithm operating with cross-correlation functions should be preferably be used. The selection of the simplest algorithm possible contributes to acceleration of the sewing process and consequently to optimal utilization of the sewing machine. Accurate knowledge of the obliquity of the pattern, which can also be determined by means of the additional image sensor and the image-processing device connected to it, can be useful for computing the misalignment. Based on this information, it is possible, e.g., to optimally set the threshold of a correlation function used to compute the misalignment. Information on the register length obtained with the image-processing device can be used to set the pattern block length for computing the cross correlation. Based on the same information, it is also possible to perform adjustments to uniformly distribute the necessary feed correction to eliminate the pattern misalignment over those parts of the sewing section which contain no pattern information, so that curling of the seam that may be caused by the correction will be kept at a minimum.

The image sensor used may be a two-dimensional sensor, from the image signal of which the said characteristics can be derived by means of the image-processing device without having to move the sensor and the fabric part relative to one another. The use of a two-dimensional sensor is particularly advantageous when setting data for a device for two-dimensional misalignment correction are to be generated. The two-dimensional sensor is preferably a color-discriminating sensor, so that the image-processing device is also able to obtain information on the colors of the pattern and generate setting data for selecting a narrow band filter in the path of rays of the pattern sensor.

Finally, the additional image sensor and the image-processing device connected to it also make it possible to generate data for setting a so-called "thread noise filter" which is arranged in the path of the pattern signals in order to filter out the frequency components which are induced by fine fabric structures of the fabric parts and contain no information on the actual pattern. To achieve this, the image-processing device determines from the image signal sent by the two-dimensional sensor the spatial frequency of a pronounced periodic component that has a substantially higher frequency than the pattern components to be detected (in the scanning direction). By multiplying the value of this spatial frequency by the feed velocity of the fabric in the sewing machine, the value of the frequency at which the high- frequency periodic pattern structures are manifested in the pattern signals (so-called thread noise) is obtained. The thread noise filters are preferably low-pass filters whose limiting frequency is set by associated adjusting means such that the above-mentioned thread noise frequency will be suppressed in the pattern signals.

The image-processing device provided additionally may be associated either to a single sewing machine or to a plurality of sewing machines. The fabric characteristics and the corresponding settings for the sewing machine are determined for each fabric part or the respective first fabric part in a bundle of identical fabric parts. The setting values associated with the fabric characteristics are coded, and the fabric parts or the first fabric part in a bundle of identical fabric parts are correspondingly marked. This can be done with a bar code bonded to the fabric part with a paper strip. The fabric parts are subsequently brought to the corresponding sewing machines. A reading device recognizes the marking and transmits the setting parameters to the sewing machine.

The present invention will be explained below in greater detail on the basis of an embodiment with respect to drawings:

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figures 1, 4:
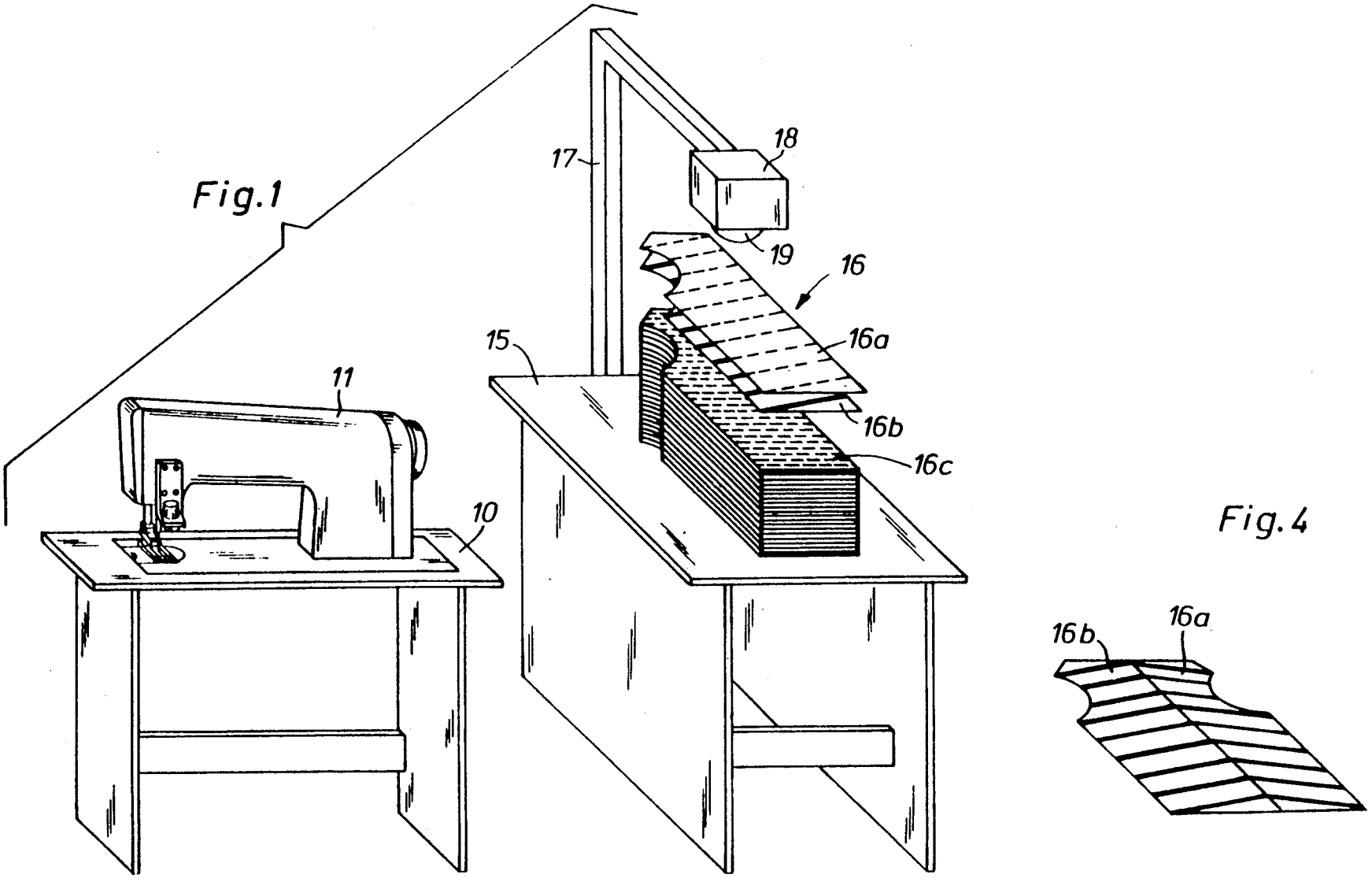
FIG. 1 is a perspective schematic view showing how the device according to the present invention can be installed.
FIG. 4 is a perspective view showing two fabric parts sewn together according to the pattern.

FIG. 1 shows, to the left, a work table 10 with a sewing machine 11 arranged on it. The sewing machine 10 is to be used for sewing together two fabric parts placed one on top of another. The sewing machine 11 corresponds to the sewing machine disclosed in DE 39,17,120 A1 which is hereby incorporated by reference, and is provided with auxiliary devices for sewing according to the pattern, which are partially represented in FIG. 2 in a block form and comprise essentially the following:

- a separate feed system for each fabric part, which is able to move the fabric part in question at least in the direction of sewing, but possibly also at right angles to the direction of sewing;
- a separate pattern sensor for each fabric part, which optically scans the fabric part in question at least in the direction of sewing (but, if desired, also at right angles to it) in order to generate an electrical pattern signal which represents the pattern-dependent light intensity variations in the scanning direction in question;
- a correcting device which determines the spatial misalignment of the patterns of the two fabric parts by comparative analysis of the pattern signals of the two pattern sensors and acts on at least one of the feed systems to correct this misalignment;
- setting means for setting operating parameters or operating states of the functional group formed by the pattern sensors and the correction device depending on the basic characteristics of the patterns of the fabric parts.

Since these devices are described in detail in the above-mentioned DE 39,17,120 A1, they do not need to be explained again here in detail.

The side table 15 shown in the right-hand part of FIG. 1 serves as an intermediate storage surface for the fabric parts 16 to be sewn together, which are already cut to the desired size and shape and form a stack on the side table 15. The fabric parts 16 are preferably stacked one on top of another such that all the edges at which sewing together is to be performed have the same orientation within the stack. In the case shown, these edges that are to be sewn are on the right.

If the pattern sensors are arranged as in the case of the sewing machine known from DE 39,17,120, in which the left-hand side is scanned in each of the two fabric parts to be sewn together, only fabrics with continuous patterns can be processed, in which mutually corresponding patterns, e.g., patterns produced by weaving, are visible on the right side and the left side as well. The type of pattern may be different and may consist of, e.g., stripes extending at right angles to, along, or obliquely to the direction of sewing. The pattern may also be checkered or consist of intersecting stripes. Other basic characteristics of the pattern, which differ from one case to the next, are, e.g., the colors of the pattern components; the contrast of the pattern (lightness difference between the lightest and darkest pattern components); the average or background lightness of the pattern; the sharpness of the pattern (abrupt or gradual transition between the pattern components); and the register length of the pattern (repetition period of the pattern components). Two relatively simple patterns, namely, a first pattern consisting of broad, obliquely extending stripes on the two topmost fabric parts 16*a* and 16*b* of the stack, and a second pattern consisting of narrow, closely spaced transverse stripes on the subjacent fabric parts 16c of the stack, are shown in FIG. 1 as examples of many imaginable types of patterns. Since two fabric parts of identical pattern each are always to be sewn together, the corresponding pairs, such as the fabric parts 16a and 16b, are located directly one on top of another. In the example according to FIG. 1, the fabric parts 16a, 16b of each pair of fabric parts face one another with their faces, so that the top side of the first or top fabric part 16a of a pair of fabric parts is the left-hand side, and the top side of the second or subjacent fabric part 16b is the right-hand side of the fabric. These relations are illustrated in FIG. 1 in such a way that the left-hand side pattern of the fabric layer 16a is represented by broken lines, and the right-hand side pattern of the fabric layer 16b is represented by solid lines.

Above the stack of fabric part 16, an image sensor 18, which is preferably a color-discriminating two-dimensional sensor, e.g., a CCD color television camera, is arranged on a bracket 17. An optical system 19 arranged in front of it images the surface of the topmost fabric part of the stack, which is illuminated with a floodlight projector (not shown), onto the light-receiving surface of the image sensor 18. To guarantee sharp imaging regardless of the height of the stack, the optical system 19 is preferably provided with a known automatic focusing unit. The color image signals produced by the image sensor 18, which contain all the information on the pattern of the fabric part being recorded, are sent to an image-processing device which obtains information from these data in order to optimally adjust the above-mentioned devices located on the sewing machine 11, which serve to determine and correct the pattern misalignment during sewing, to the actual fabric pattern. These devices are schematically represented in the right-hand part of the block diagram in FIG. 2. They contain two light sources 31a and 31b which illuminate the two fabric parts 16a and 16b to be sewn together in the sewing machine. The light reflected by the fabric part in question is deflected via an optical filter device 32a or 32b of selectable color to a light receiver 33a or 33b, respectively, whose electrical output signal is sent via an amplifier 34a or 34b, respectively, to a low-pass filter 35a or 35b, respectively, which has a selectable limit frequency. The components 32a, 32b through 35a, 35b form two pattern sensors 36a and 36b. The output signals of the two filters 35a and 35b are the two pattern signals Ma and Mb of the two pattern sensors 36a and 36b, respectively. These pattern signals reflect the instantaneous value of the intensity of the light received by the respective light receiver 33a or 33b, and when the two fabric parts 16a and 16b are being moved by the associated feed mechanisms 50a and 50b, respectively, in the direction of sewing, the amplitude of the pattern signals will change corresponding to the pattern-dependent variations in light intensity at the scanning site of the pattern sensors. A correcting computer 40 determines from the two pattern signals Ma and Mb the spatial misalignment of the patterns of the two fabric parts 16a and 16b, and generates, for at least one of the feed mechanisms, e.g., for the device 50a, a control signal Sa, which increases or decreases the velocity of feed of the respective fabric part depending on the amount and direction of the pattern misalignment determined in order to move the two fabric parts relative to one another such that the patterns will be aligned, i.e., the pattern misalignment will disappear.

The correcting computer 40 is preferably a digital microprocessor that may contain various computation programs (algorithms) for determining the pattern misalignment, as will be described below. In order for the computer 40 to receive the pattern signals Ma and Mb in the necessary digital form, an analog-digital converter (not specifically shown) is provided for each of these signals.

Figure 2:
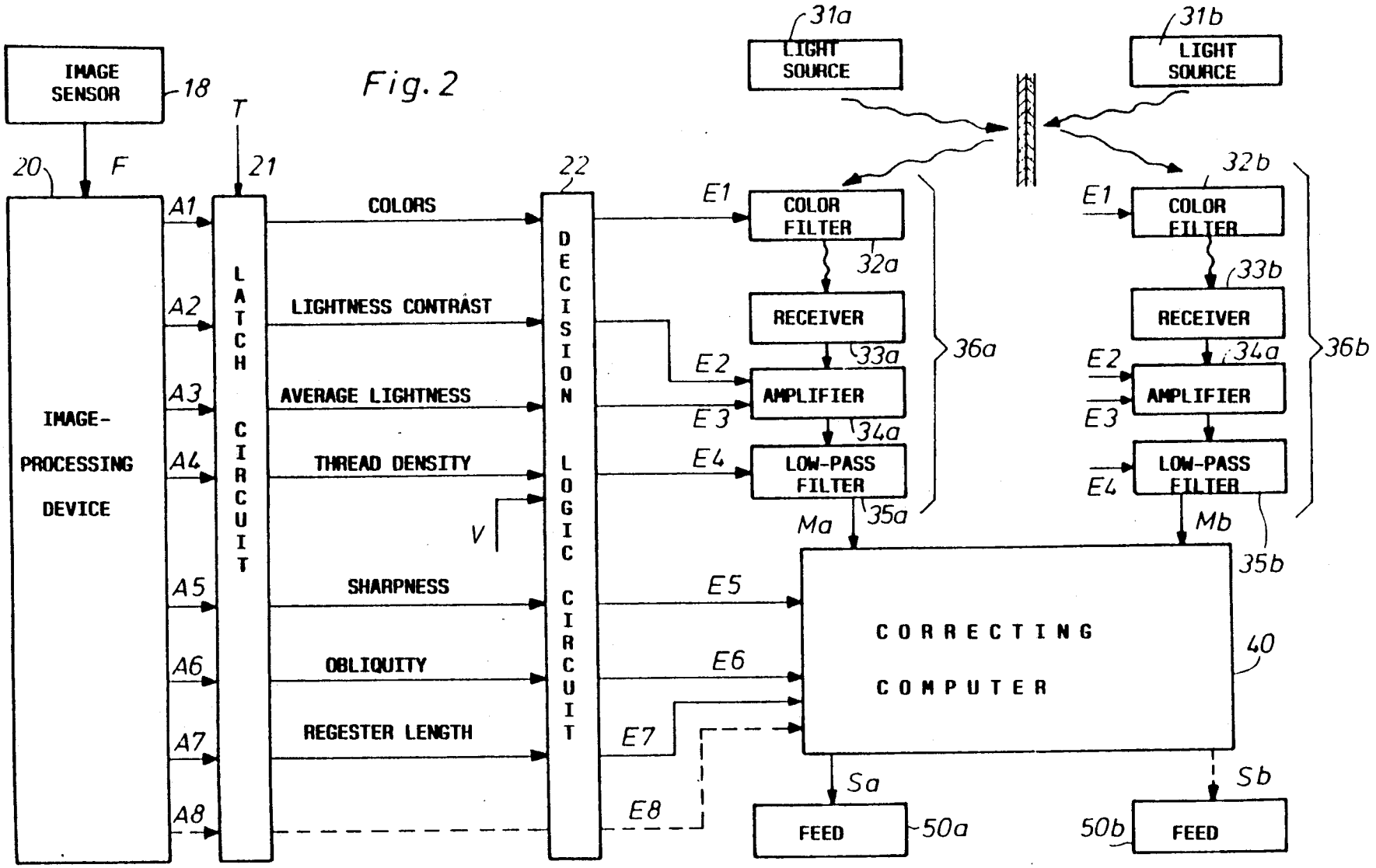
FIG. 2 is a block diagram of a device according to the present invention.

Prior to the beginning of the sewing operation, the machine operator turns on the image sensor 18 and the image-processing device 20 connected to it, which is shown in the left-hand part of the block diagram in FIG. 2. The image sensor 18 scans the image of the surface of the topmost fabric part 16a of the stack, which is focused by the interposed optical system 19 on its image-receiving surface, in order to produce a color image signal F representing information content of this image in a known manner, and this signal is sent to the image-processing device 20. The image-processing device 20 analyzes the color image signal F in order to detect various basic characteristics of the fabric pattern and to provide corresponding characteristic data A1 through A8 at associated outputs. These data are temporarily stored in a latch circuit 21 in order to enter, as necessary, a decision logic circuit 22, which elaborates setting data E1 through E8 from them for controlling sewing according to the pattern.

One of the characteristic data that is generated by the image-processing device 20 and stored in the latch circuit 21 is information A1 on the color of the fabric pattern. This information can indicate the two colors between which the pattern varies and how far the pattern components of different colors differ in lightness. In the case of a slight difference in lightness of pattern components of different colors, the decision logic circuit 22 sends color setting data E1 to the color filter device 32a, 32b, in order to insert an optical filter with the narrowest band possible in the path of rays between the fabric parts 16a, 16b and the associated light receivers 33a, 33b for selecting one of the colors. The filter device 32a, 32b may be, e.g., a set of a plurality of narrow-band color filters which are arranged on a rotatable disk and can be moved into the path of rays by means of a stepping motor driving the disk. It is also possible to arrange the filters in the path of the light emitted by the light sources. If a single light source, whose light is deflected by prisms or mirrors onto the two fabric parts 16a, 16b, is used instead of two light sources, a single filter device at the outlet of this single light source is sufficient.

Further pieces of information from the image-processing device 20 may be, e.g., a lightness contrast value A2 and an average lightness value A3 of the pattern being scanned by the image sensor 18. The first value represents the peak-to-peak amplitudes of the luminous density component of the color image signal F, while the second value represents the mean value of the luminous density. A setting signal E2 for the gain of the amplifiers 34a and 34b is obtained from the lightness contrast value A2 in the decision logic circuit 22, while a setting signal E3 for the bias voltage or the offset of the amplifiers is obtained from the lightness mean value A3. To achieve this, the decision logic circuit 22 may have, e.g., ROM memories which are addressed by the characteristic data A2 and A3 and contain the associated setting value E2 at the corresponding memory locations.

The image-processing device 20 may also derive from the color image signal F information A4 on the spatial frequency of high-frequency periodic structures of the fabric part being scanned by the image sensor 18. Such high-frequency structures, which are formed by individual threads of the fabric, cause in the pattern signals a component of relatively high frequency, which is superimposed on the pattern-dependent intensity variations and makes their analysis in the correcting computer 40 difficult. Besides the spatial frequency value A4, the decision logic circuit 22 also receives a signal V which represents the instantaneous velocity of fabric feed in the machine. The mathematical product of the spatial frequency value A4 and the velocity of feed V is formed in the decision logic circuit 22 in order to obtain a value which indicates the "thread noise frequency" in the pattern signal and can be used to set the limit frequency of the low-pass filters 35*a* and 35*b* such that this thread noise frequency will be suppressed.

Based on information A5 on the edge sharpness of the pattern components, which is obtained from the image-processing device 20, it is possible to decide which algorithm the correcting computer 40 should select to compute the pattern misalignment from the pattern signals Ma and Mb. In the case of patterns with sharp edges, it is possible to use a relatively simple algorithm, which compares the flanks of the two pattern signals to one another, while in the case of nonsharp pattern components or pattern components showing gradual transition, it is better to compute the misalignment by the cross-correlation function. The decision logic circuit 22 is able to obtain from the sharpness information A5 a setting signal E5 for the correcting computer 40 for selecting the favorable algorithm. Similarly, the decision logic circuit 22 is able to obtain—from the information A6 obtained on the obliquity of the pattern—a setting signal E6 with which a threshold for the cross-correlation function used to compute the misalignment is set in the correcting computer 11.

Information A7 supplied by the image-processing device 20 on the register length of the pattern can be fed into the correcting computer 40 in order to enable the computer to distribute—in the case of great register lengths—the necessary feed correction to eliminate the pattern misalignment that may have been measured uniformly over those parts of the sewing section in which no pattern-dependent variations of the intensity of the pattern signals occur. This measure, which is also known from DE 39,02,474 A1, prevents curling of the fabric parts in the case of misalignment correction if the register length is too great.

Besides the types of information A1 through A7 listed above, the image-processing device 20 is, of course, also able to analyze other basic characteristics of the pattern scanned by the image sensor 18 in order to obtain further setting data for controlling the sewing machine or parameters for the algorithms of the correcting computer 40. This is symbolically indicated in broken line in FIG. 2 by an additional output A8 of the image-processing device 20 and an associated setting connection E8 leading to the correcting computer 40. The characteristic data obtained with the image-processing device 20 can also be processed for performing further setting or selection functions; for example, information A6 on the obliquity of the pattern can be fed as a computation parameter into the correcting computer in order to simplify the algorithm used there for misalignment computation.

The characteristic data supplied by the image-processing device 20 and stored in the latch circuit 21 can be transformed, on a transfer command T, to the decision logic circuit 22 in order to obtain the desired setting data E1 through E8 and to perform the corresponding settings. The machine operator can then remove the topmost fabric parts 16*a* and 16*b* and feed them into the sewing machine lying one on top of another with their faces together for being sewn together according to the correct pattern. Since the pattern information was obtained from the left-hand side of the top fabric part 16*a*, and the respective left-hand sides of both fabric parts 16*a* and 16*b* are being scanned during sewing, the pattern characteristic data originating from the fabric part 16*a* are valid in the same manner for the fabric part 16*b* as well.

Figure 3:
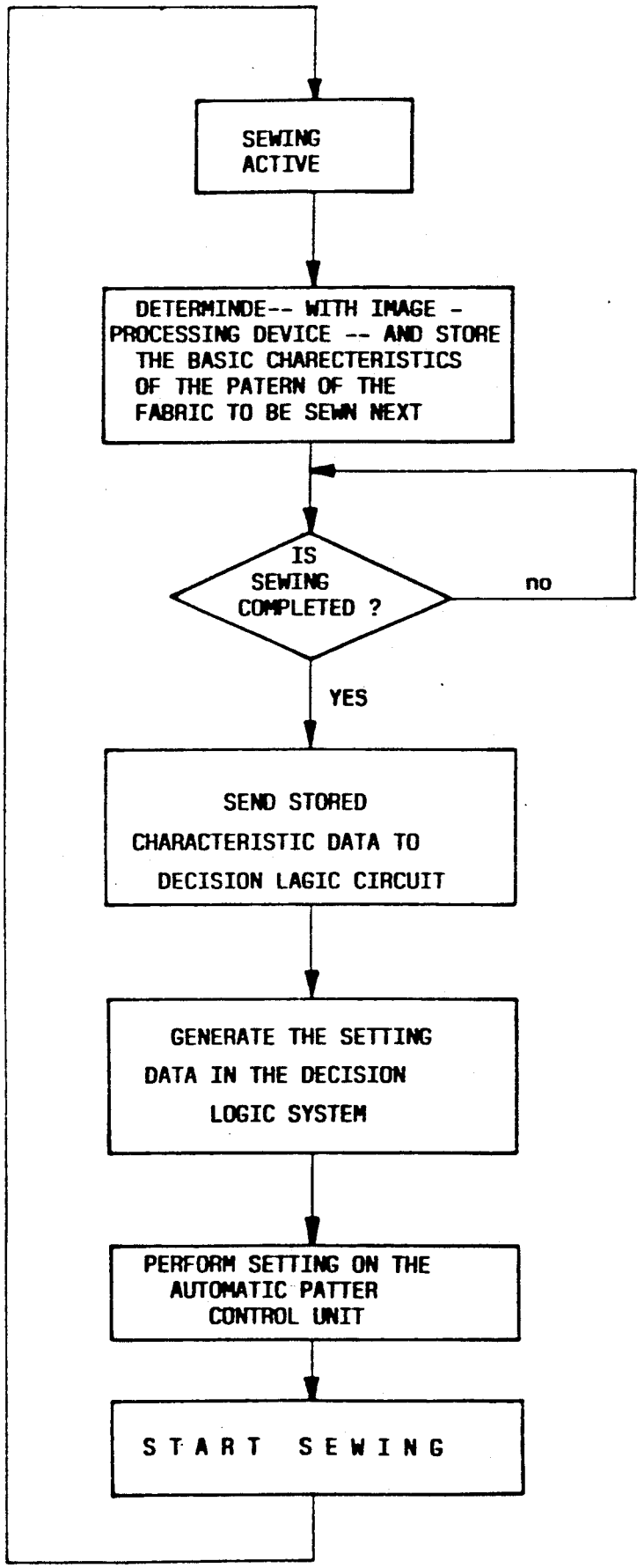
FIG. 3 is a flow chart of the operation of the device according to the present invention.

During the automatic sewing of these fabric parts according to the pattern by means of the optimally adjusted pattern sensors 36*a* and 36*b* and the optimally adjusted correcting computer 40, the image sensor 18 is able to scan the surface of the next fabric part 16*c* on the stack, and the image-processing device 20 is able to analyze the desired characteristic data of the pattern of this fabric part and store them in the latch circuit 21. When the sewing together of the fabric parts 16*a*, 16*b* removed previously is complete, the transfer command T is again sent in order to send the characteristic data being stored in the latch circuit 21 into the decision logic circuit 22, which will subsequently set the pattern sensors 36*a* and 36*b* and the correcting computer 40 for the fabric part 16*c* to be sewn next. This sequence of operations is represented in the flow chart in FIG. 3.

Both the image-processing device 20 and the decision logic circuit 22, like the correcting computer 40, are preferably designed as digital units, and the characteristic data A1 through A8, as well as the setting data E1 through E8 are digital values. The decision logic circuit 22 and the correcting computer 40, which are represented as separate blocks in FIG. 2, may be realized, if desired, as a single microcomputer by proper organization.

While a specific embodiment of the invention has been shown and described in detail to illustrate the application of the principles of the invention, it will be understood that the invention may be embodied otherwise without departing from such principles.

What is claimed is:

1. A device for sewing together two fabric parts according to a pattern on the fabric parts, comprising: a sewing machine including a separate feed mechanism for feeding each of the two fabric parts to be sewn together; two separate pattern sensors located adjacent a stitch formation site of the sewing machine, each of said two separate pattern sensors optically scanning a fabric part in at least one predetermined direction relative to an edge of the fabric part to be sewn and generating a pattern signal representing pattern-dependent variations in light intensity; correcting means for determining a one-dimensional or two-dimensional misalignment of the patterns of the two fabric parts by comparative analysis of a pattern signal of each of the two pattern sensors and acting on at least one of said feed mechanisms to correct said misalignment; setting means for setting operation parameters of a functional group formed by the pattern sensors and said correcting means as a function of basic characteristics of the patterns of the fabric parts; an additional image sensor positioned for viewing a site at which fabric parts are temporarily stored before being fed to said sewing machine, said additional image sensor optically scanning a pattern of a fabric part located at said site and generating a corresponding image signal; an image signal processing device for generating characteristic data from said image signal, said characteristic data corresponding to basic characteristics of the pattern scanned; a memory device receiving said characteristic data from said image processing device and storing said characteristic data; a decision logic circuit for generating setting data for said operating parameters based on said characteristic data, said operating parameters being sent to said setting means; and, transfer means, activated before a beginning of a sewing process for sending said characteristic data from said memory device to said decision logic circuit.

2. A device according to claim 1, wherein said setting means includes a final control element for amplifying an amplitude offset of said two pattern signals; said image processing device generating data including lightness contrast and average lightness of a pattern scanned based on said image signal of the additional image sensor; said decision logic circuit generating setting data for said final control element for controlling amplification and offset based on said lightness contrast and average lightness data.

3. A device according to claim 1, wherein said setting means includes a color selection device for selectable analysis of light of different colors in each of said two separate pattern sensors; said additionally provided image sensor being provided as a light-discriminating sensor; said image processing device supplying data in the form of color data based on the colors of the components of a pattern scanned; said decision logic circuit generating setting data based on said color data for selecting a color in which pattern-dependent amplitude differences of pattern signals have their maximum.

4. A device according to claim 3, wherein said color selection device includes a plurality of narrow-band color filters insertable into a path of rays of each of said two separate pattern sensors.

5. A device according to claim 1, wherein said correcting device is switchable between one of two different algorithms for determining pattern misalignment; said logic circuit generating said setting data for selecting a most suitable algorithm in a particular case based on characteristic data generated by said image processing device.

6. A device according to claim 5, wherein said characteristic data generated by said image-processing device includes data representing edge sharpness of components of the pattern scanned.

7. A device according to claim 1, wherein said setting means includes inputs for entering at least one computation parameter, said correcting device including at least one algorithm using said computation parameter as an independent variable characteristic of an actual pattern of the fabric part scanned by said additionally provided image sensor; said image processing device generating data for determining said computation parameter; said decision logic circuit determining said computation parameter based on said characteristic data.

8. A device according to claim 7, wherein one element of said characteristic data obtained to determine said computation parameter is an angular orientation of stripes of a pattern relative to an edge to be sewn.

9. A device according to claim 8, wherein said algorithm used by said correcting means to compute pattern misalignment includes the formation of a cross-correlation function of pattern signals of the two pattern sensors, said setting means setting a threshold for said correlation function depending on a computation parameter representing said angular orientation.

10. A device according to claim 7, wherein one element of said characteristic data used for determining said computation parameter is a register length of a pattern scanned by said additionally provided image sensor.

11. A device according to claim 10, wherein said algorithm used in said correcting device to compute pattern misalignment includes the formation of a cross-correlation function of pattern signals of said two pattern sensors, said setting means setting a pattern block length for computing said cross-correlation function depending on said computation parameter representing the register length.

12. A device according to claim wherein said image processing device drives data corresponding to a spatial frequency of an optically recognizable period structure of the pattern scanned in a given pattern direction, said period structure being denser than a pattern structure to be detected for misalignment correction; said decision logic circuit including an input for said spatial frequency data and for information on a current feed velocity of the fabric parts in the sewing machine in order to determine a product of the spatial frequency and an actual feed velocity; a controllable low-pass filter including a control input receiving a control signal corresponding to said product from the decision logic circuit, for adjusting a limit frequency of the low-pass filter, said low-pass filter suppressing a frequency corresponding to said product, said low-pass filter filtering said pattern signal from said two pattern sensors as said pattern signal is sent to said correcting device.

13. A device according to claim 1, wherein said additionally provided image sensor includes a two-dimensional sensor with an optical system arranged in front of it, said optical system images an area of an inserted fabric part onto the light-receiving surface of the image sensor, said area being at least slightly larger than a register length of the pattern in a predetermined scanning direction.

14. A device according to claim 1, wherein said additionally provided image sensor scans in two predetermined scanning directions in the plane of the fabric parts, one scanning direction being parallel to an edge to be sewn and another scanning direction being perpendicular to an edge to be sewn.

* * * * *